US009889980B2

(12) United States Patent
Shi

(10) Patent No.: US 9,889,980 B2
(45) Date of Patent: Feb. 13, 2018

(54) DIVIDABLE PACKAGING STRUCTURE

(71) Applicant: Shenzhen China Star Optoelectronics Technology Co., Ltd., Shenzhen, Guangdong (CN)

(72) Inventor: Qinjun Shi, Shenzhen (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 304 days.

(21) Appl. No.: 14/360,623

(22) PCT Filed: Apr. 22, 2014

(86) PCT No.: PCT/CN2014/075992
§ 371 (c)(1),
(2) Date: May 25, 2014

(87) PCT Pub. No.: WO2015/149400
PCT Pub. Date: Oct. 8, 2015

(65) Prior Publication Data

US 2015/0360836 A1 Dec. 17, 2015

(30) Foreign Application Priority Data

Apr. 3, 2014 (CN) ..... 2014 1 0134676

(51) Int. Cl.
*B65D 61/00* (2006.01)
*B65D 85/48* (2006.01)
*B65D 57/00* (2006.01)

(52) U.S. Cl.
CPC ..... *B65D 61/00* (2013.01); *B65D 57/00* (2013.01); *B65D 85/48* (2013.01)

(58) Field of Classification Search
CPC ..... B65D 61/00; B65D 57/00; B65D 85/48
See application file for complete search history.

(56) References Cited

U.S. PATENT DOCUMENTS 4,205,486 A * 6/1980 Guarnacci ..... E06B 3/205 403/231
4,240,765 A * 12/1980 Offterdinger ..... E06B 3/9765 29/897.312

(Continued)

FOREIGN PATENT DOCUMENTS

CN 202321131 U 7/2012
CN 102910380 A 2/2013

*Primary Examiner* — Anthony Stashick
*Assistant Examiner* — James Way
(74) *Attorney, Agent, or Firm* — Andrew C. Cheng

(57) ABSTRACT

The present invention provides a dividable packaging structure, which includes: a plurality of first and second side frame members (2, 4) and a plurality of corner connection pieces (6) respectively connected to the first and second side frame members (2, 4). The plurality of corner connection pieces (6) connects the first side frame members (2) and the second side frame members (4) together to form a frame. The dividable packaging structure of the present invention has a dividable and thus splittable configuration, allowing for effective reduction of material cost. To package an object, the frame carries and supports the objet and the corner connection pieces provide positioning of the object to effectively prevent the object from shifting during shipment that may lead to occurrence of deformation of the objet.

15 Claims, 6 Drawing Sheets

(56) References Cited

U.S. PATENT DOCUMENTS

| | | | | | |
|---|---|---|---|---|---|
| 4,570,406 | A * | 2/1986 | DiFazio | E04C 2/384 | 160/381 |
| 5,447,233 | A * | 9/1995 | Smith | B65D 81/057 | 206/453 |
| 5,870,868 | A * | 2/1999 | Kita | E04C 2/384 | 312/140 |
| 6,067,760 | A * | 5/2000 | Nowell | E06B 3/26347 | 403/231 |
| D461,714 | S * | 8/2002 | Hamada | D9/456 | |
| 6,527,278 | B1 * | 3/2003 | Norris | E06B 7/2301 | 277/628 |
| D564,880 | S * | 3/2008 | Chang | D9/456 | |
| 7,677,003 | B2 * | 3/2010 | Baughn | E06B 3/9682 | 52/473 |
| 8,028,489 | B1 * | 10/2011 | Lawrence | E06B 3/9641 | 52/204.57 |
| 2006/0005875 | A1 * | 1/2006 | Haberlein | B65D 57/00 | 136/251 |
| 2007/0039848 | A1 * | 2/2007 | Burchell | B65D 81/057 | 206/453 |
| 2014/0091000 | A1 * | 4/2014 | Kuo | B65D 85/48 | 206/454 |
| 2014/0367305 | A1 * | 12/2014 | Mizuo | B65D 85/48 | 206/585 |

* cited by examiner

DIVIDABLE PACKAGING STRUCTURE

BACKGROUND OF THE INVENTION

1. Field of the Invention

The present invention relates to the field of packaging, and in particular to a dividable packaging structure for a front bezel of a liquid crystal module.

2. The Related Arts

Liquid crystal displays (LCDs) have a variety of advantages, such as thin device body, low power consumption, and being free of radiation, and are thus of wide applications, such as mobile phones, personal digital assistants (PDAs), digital cameras, computer monitors, and notebook computer screens.

Most of the liquid crystal displays that are currently available in the market are backlighting liquid crystal displays, which comprise an enclosure, a liquid crystal panel arranged in the enclosure, and a backlight module mounted in the enclosure. The structure of a conventional liquid crystal panel is composed of a color filter (CF) substrate, a thin-film transistor (TFT) array substrate, and a liquid crystal layer arranged between the two substrates and the principle of operation is that a driving voltage is applied to the two glass substrates to control rotation of the liquid crystal molecules of the liquid crystal layer in order to refract out light emitting from the backlight module to generate images. Since the liquid crystal panel itself does not emit light, light must be provided from the backlight module in order to normally display images. Thus, the backlight module is one of the key components of the liquid crystal displays. The backlight modules can be classified in two types, namely a side-edge backlight module and a direct backlight module, according to the site where light gets incident. The direct backlight module comprises a light source, such as a cold cathode fluorescent lamp (CCFL) or a light-emitting diode (LED), which is arranged at the backside of the liquid crystal panel to form a planar light source directly supplied to the liquid crystal display panel. The side-edge backlight module comprises an LED light bar, serving as a backlight source, which is arranged at an edge of a backplane to be located rearward of one side of the liquid crystal display panel. The LED light bar emits light that enters a light guide plate (LGP) through a light incident face at one side of the light guide plate and is projected out of a light emergence face of the light guide plate, after being reflected and diffused, to pass through an optic film assembly so as to form a planar light source for the liquid crystal panel.

Referring to FIG. 1, a conventional liquid crystal module generally comprises a backlight module 100, a liquid crystal display panel 300 mounted on the backlight module 100, and a front bezel 500 mounted to the liquid crystal display panel 300. With the progress of human society, bezel slimming is now a trend for the liquid crystal modules and this makes the side frames of the bezel 500 increasingly slimming.

Before a liquid crystal module is assembled, the front bezel must be packaged for storage. Heretofore, in the industry, the packaging of the module bezel is achieved with carton packages in the interior thereof vacuum-molded retention slots are arranged vertically to receive and retain the front bezels. Due to the gravity of the bezel positioned in a vertical arrangement, the bezel is susceptible to deflection and deformation. A packaging method that is currently available to improve such an issue is subjecting a sheet of rolled PET material having a size slightly greater than external dimensions of the bezel to vacuum molding to form vacuum-molded trays that are horizontally stackable to receive and support and stack the bezel in such a way that each tray carries a bezel. However, this method takes a large consumption of material so that the packaging expense is tens of times higher than the vertical packaging arrangement, making the cost extremely high.

SUMMARY OF THE INVENTION

An object of the present invention is to provide a dividable packaging structure, which is a simple structure, has a low cost, and can effectively prevent a packaged object from deforming.

To achieve the above object, the present invention provides a dividable packaging structure, which comprises: a plurality of first and second side frame members and a plurality of corner connection pieces respectively connected to the first and second side frame members. The plurality of corner connection pieces connects the first side frame members and the second side frame members together to form a frame.

The first and second side frame members have the same thickness. The corner connection pieces each have outer sides that comprise engage-to-couple structures corresponding to the first and second side frame members. End sections of the first and second side frame members are engageable with and coupled to the engage-to-couple structures thereby connecting the first and second side frame members together.

The corner connection pieces each comprise a bottom surface and a top surface opposite to the bottom surface, whereby the top surface of the corner connection piece carries and supports thereon the bottom surface of another corner connection piece to thereby stack the two corner connection pieces together.

The top surface of the corner connection pieces comprises a projection and the bottom surface of the corner connection pieces comprises a receiving slot formed therein to correspond to the bottom surface, whereby the projection of a corner connection piece is receivable in the receiving slot of another corner connection piece so as to stack the two corner connection pieces together.

The engage-to-couple structures comprise engage-to-couple slots and the end sections of the first and second side frame members are engageable with and coupled to the engage-to-couple slots to thereby connect the first and second side frame members together in sequence.

The engage-to-couple structures and the end sections of the first and second side frame members are fixed together with adhesives or screwing.

The corner connection pieces are located at an inner side of the frame and the corner connection pieces project upward beyond an external surface of the frame and are adapted to position an object to be packaged, so that the frame bears and supports the object to be packaged thereon.

The number of the corner connection pieces is four; the number of the first side frame members is two that are arranged opposite to each other; and the number of the second side frame members is two that are arranged opposite to each other.

The corner connection pieces are in the form of an L-shape and the frame is rectangular.

The corner connection pieces each comprise round chamfering on an outer side thereof at two ends and a middle bend.

The present invention also provides a dividable packaging structure, which comprises: a plurality of first and second side frame members and a plurality of corner connection pieces respectively connected to the first and second side frame members, the plurality of corner connection pieces connecting the first side frame members and the second side frame members together to form a frame;

wherein the first and second side frame members have the same thickness; the corner connection pieces each have outer sides that comprises engage-to-couple structures corresponding to the first and second side frame members, end sections of the first and second side frame members being engageable with and coupled to the engage-to-couple structures thereby connecting the first and second side frame members together;

wherein the corner connection pieces each comprise a bottom surface and a top surface opposite to the bottom surface, whereby the top surface of the corner connection piece carries and supports thereon the bottom surface of another corner connection piece to thereby stack the two corner connection pieces together;

wherein the top surface of the corner connection pieces comprises a projection and the bottom surface of the corner connection pieces comprises a receiving slot formed therein to correspond to the bottom surface, whereby the projection of a corner connection piece is receivable in the receiving slot of another corner connection piece so as to stack the two corner connection pieces together;

wherein the engage-to-couple structures comprise engage-to-couple slots and the end sections of the first and second side frame members are engageable with and coupled to the engage-to-couple slots to thereby connect the first and second side frame members together in sequence; and wherein the engage-to-couple structures and the end sections of the first and second side frame members are fixed together with adhesives or screwing.

The corner connection pieces are located at an inner side of the frame and the corner connection pieces project upward beyond an external surface of the frame and are adapted to position an object to be packaged, so that the frame bears and supports the object to be packaged thereon.

The number of the corner connection pieces is four; the number of the first side frame members is two that are arranged opposite to each other; and the number of the second side frame members is two that are arranged opposite to each other.

The corner connection pieces are in the form of an L-shape and the frame is rectangular.

The corner connection pieces each comprise round chamfering on an outer side thereof at two ends and a middle bend.

The efficacy of the present invention is that the present invention provides a dividable packaging structure, which has a dividable and thus splittable configuration, allowing for effective reduction of material cost. To package an object, the frame carries and supports the object thereon and the corner connection pieces provide positioning of the object to effectively prevent the object from shifting during shipment that may lead to occurrence of deformation of the object.

For better understanding of the features and technical contents of the present invention, reference will be made to the following detailed description of the present invention and the attached drawings. However, the drawings are provided for the purposes of reference and illustration and are not intended to impose limitations to the present invention.

BRIEF DESCRIPTION OF THE DRAWINGS

The technical solution, as well as other beneficial advantages, of the present invention will be apparent from the following detailed description of embodiments of the present invention, with reference to the attached drawing. In the drawing.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
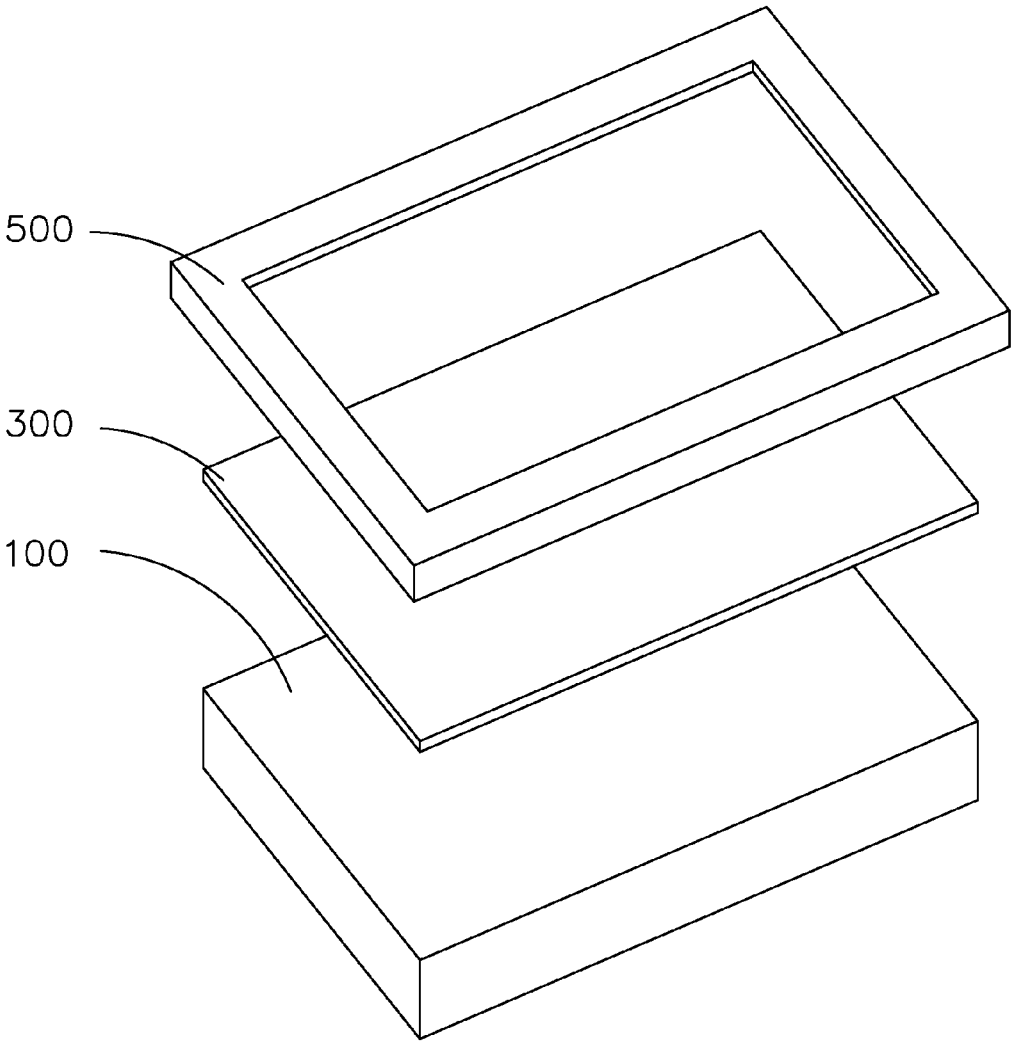
FIG. 1 is an exploded view showing a conventional liquid crystal module.
Figure 2:
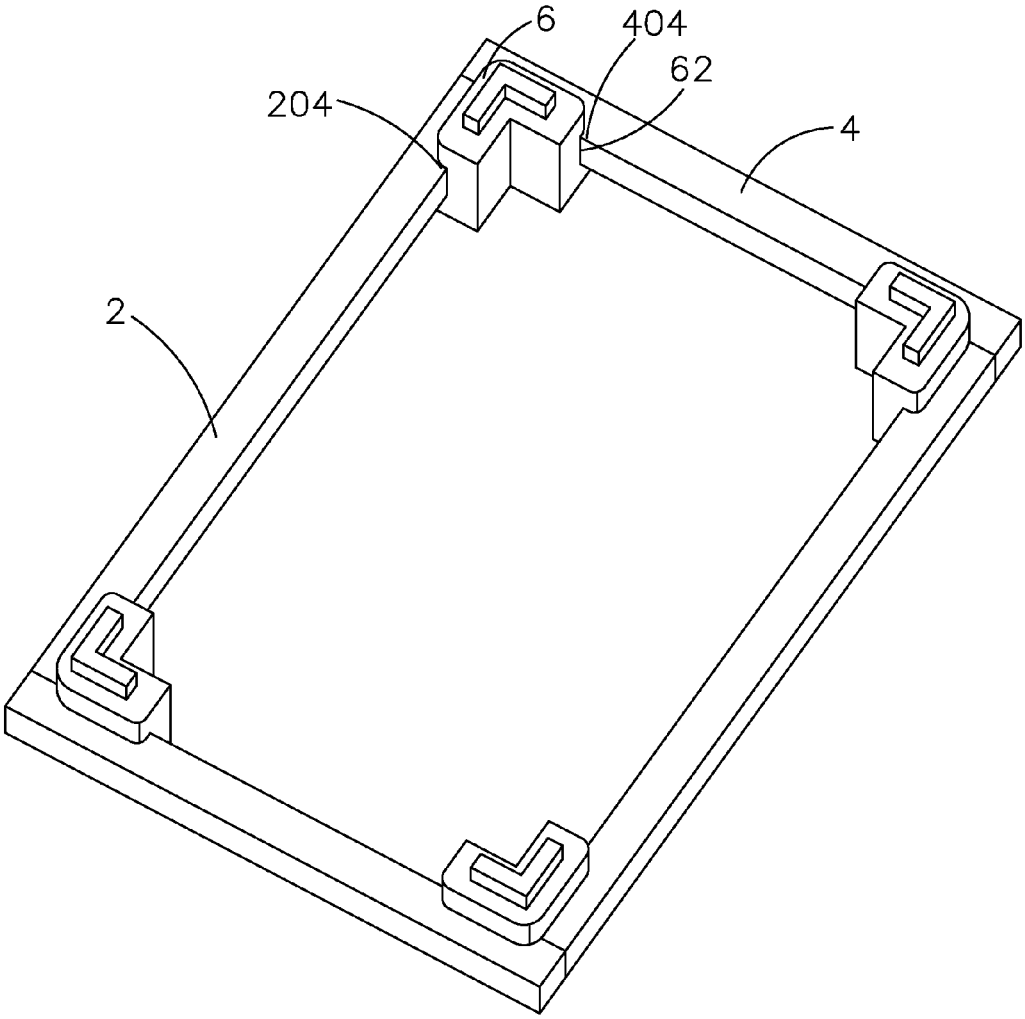
FIG. 2 is a perspective view showing a dividable packaging structure according to the present invention.

Referring to FIG. 2, the present invention provides a dividable packaging structure, which comprises: a plurality of first and second side frame members 2, 4 and a plurality of corner connection pieces 6 respectively connected to the first and second side frame members 2, 4. The plurality of corner connection pieces 6 connects the first side frame members 2 and the second side frame members 4 together to form a frame. The corner connection pieces 6 are arranged at an inner side of the frame and the corner connection pieces 6 project upward beyond an external surface of the frame to position an object to be packaged so that the frame bears and supports the object to be packaged.

In the instant embodiment, the number of the first side frame members 2 used is two and they are arranged opposite to each other; and the number of the second side frame members 2 used is two. The number of the corner connection pieces 6 used is four and they are respectively set at four corners and located at an inner side thereof in order to connect the first and second side frame members 2, 4 together to form a rectangular frame.

Taking a front bezel of a package (not shown) as an example, the first and second side frame members 2, 4 are used to carry a front bezel for effectively supporting the front bezel and preventing the front bezel from deformation during shipment. Further, the corner connection pieces 6 are used to abut an inside surface of the front bezel at four corners thereof so as to position the front bezel and prevent the front bezel from shifting that leads to the occurrence of deformation during shipment.

The first and second side frame members 2, 4 can be made of a metallic material or a plastic material. In the instant embodiment, the first and second side frame members 2, 4 are made of plastics and preferably, the first and second side frame members 2, 4 are made of phenolic plastics. The first and second side frame members 2, 4 have the same thickness in order to ensure the flatness of the entire frame structure for better bearing the front bezel. The corner connection pieces 6 are made of resins and preferably, the corner connection pieces 6 are made of acrylonitrile-butadiene-styrene copolymer. The corner connection pieces 6 each have outer sides that comprise engage-to-couple structures 62 formed therein to correspond to the first and second side frame members 2, 4. End sections 204, 404 of the first and second side frame members 2, 4 are engageable with and thus coupled to the engage-to-couple structures 62 thereby connecting the first and second side frame members 2, 4 in a leading end to tail end manner.

Specifically, the engage-to-couple structure 62 can be engage-to-couple slots and the end sections 204, 404 of the first and second side frame members 2, 4 are receivably engageable with and thus coupled to the engage-to-couple slots so as to connect the first and second side frame members 2, 4 in sequence in a leading end-to-tail end manner (as shown in FIG. 2). The engage-to-couple structures 62 and the end sections 204, 404 of the first and second side frame members 2, 4 can be fixed together by adhesives or screwing. Such ways of fixing can be achieved with any known techniques and further description will be omitted.

The structure of the corner connection pieces 6 can be designed according to practical requirement and this does not affect the technical effectiveness of the present invention. Specifically, in the instant embodiment, the corner connection pieces 6 are made in the form of an L-shape and the corner connection pieces 6 each comprise round chamfering formed on an outer surface thereof at two ends and the middle bend to prevent the corner connection pieces 6 from scratching and damaging an outside surface of the front bezel when the front bezel is positioned against the corner connection pieces 6.

Figure 3:
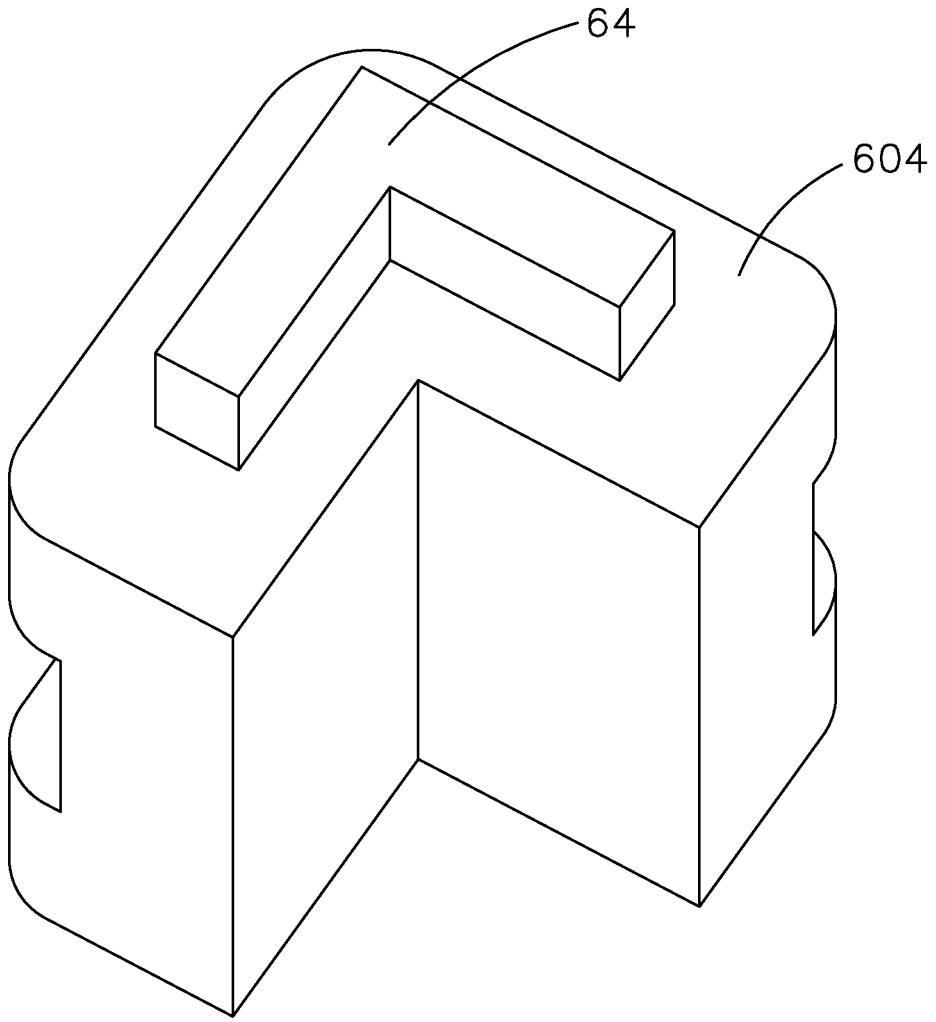
FIG. 3 is a front-side perspective view showing a corner connection piece of the dividable packaging structure according to the present invention.
Figure 4:
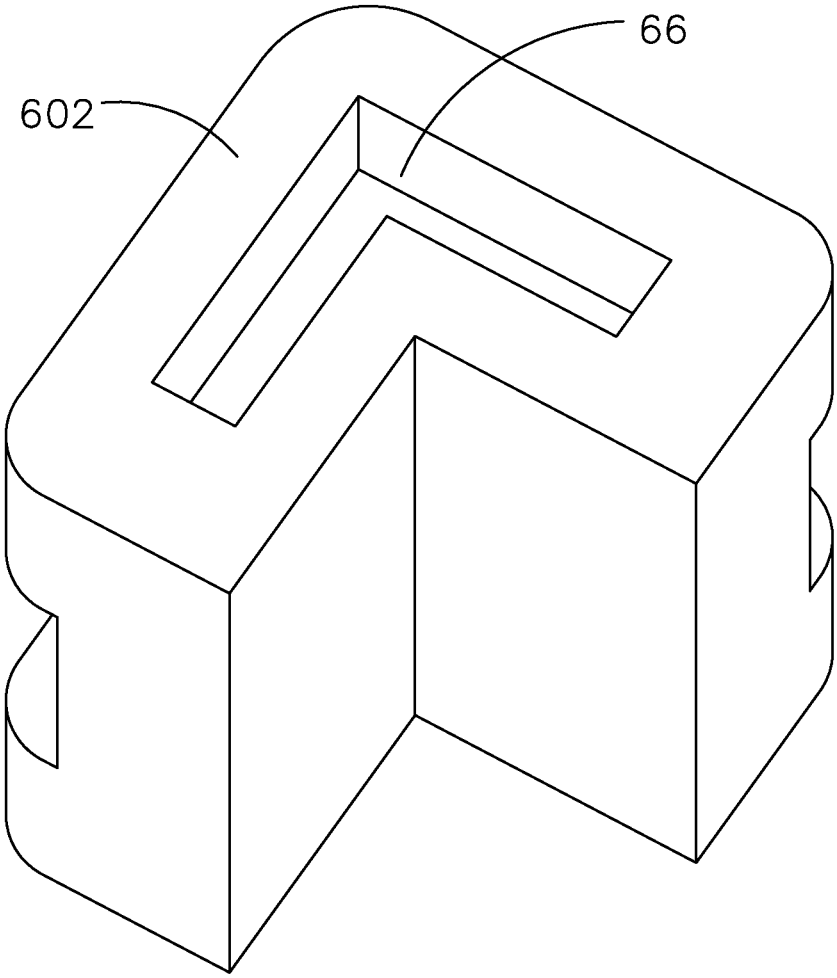
FIG. 4 is a rear-side perspective view showing the corner connection piece of the dividable packaging structure according to the present invention.
Figure 5:
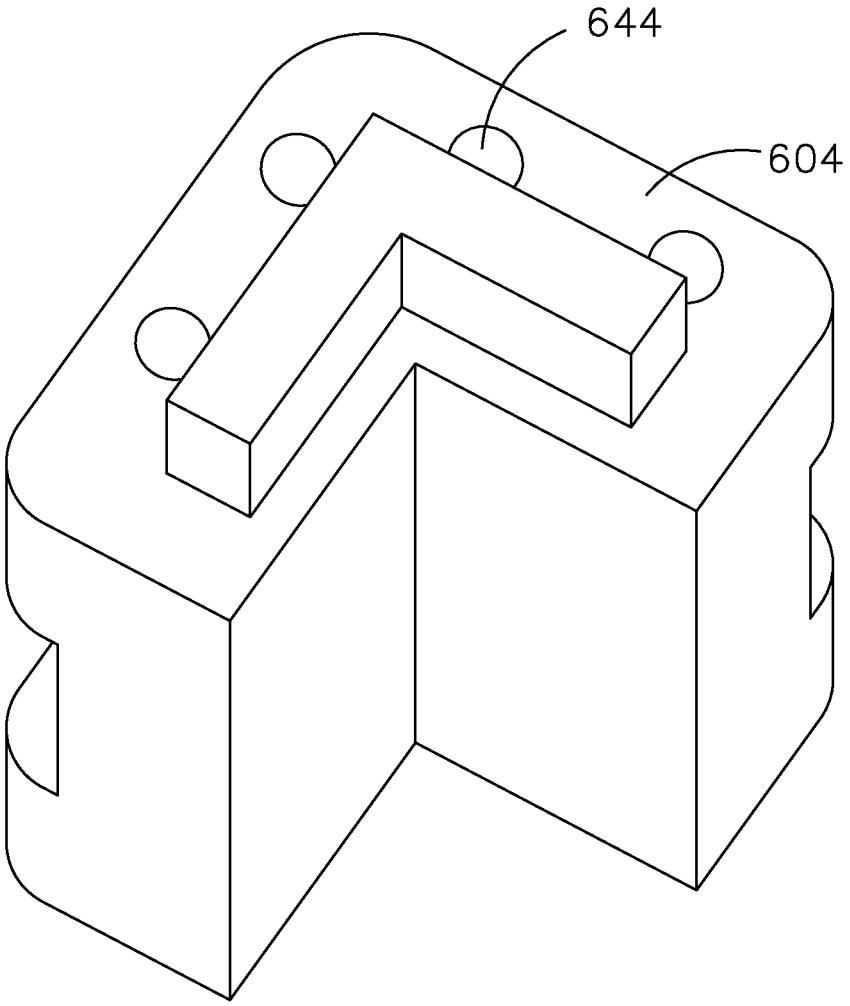
FIG. 5 is a perspective view showing a corner connection piece of the dividable packaging structure according to another embodiment of the present invention.
Figure 6:
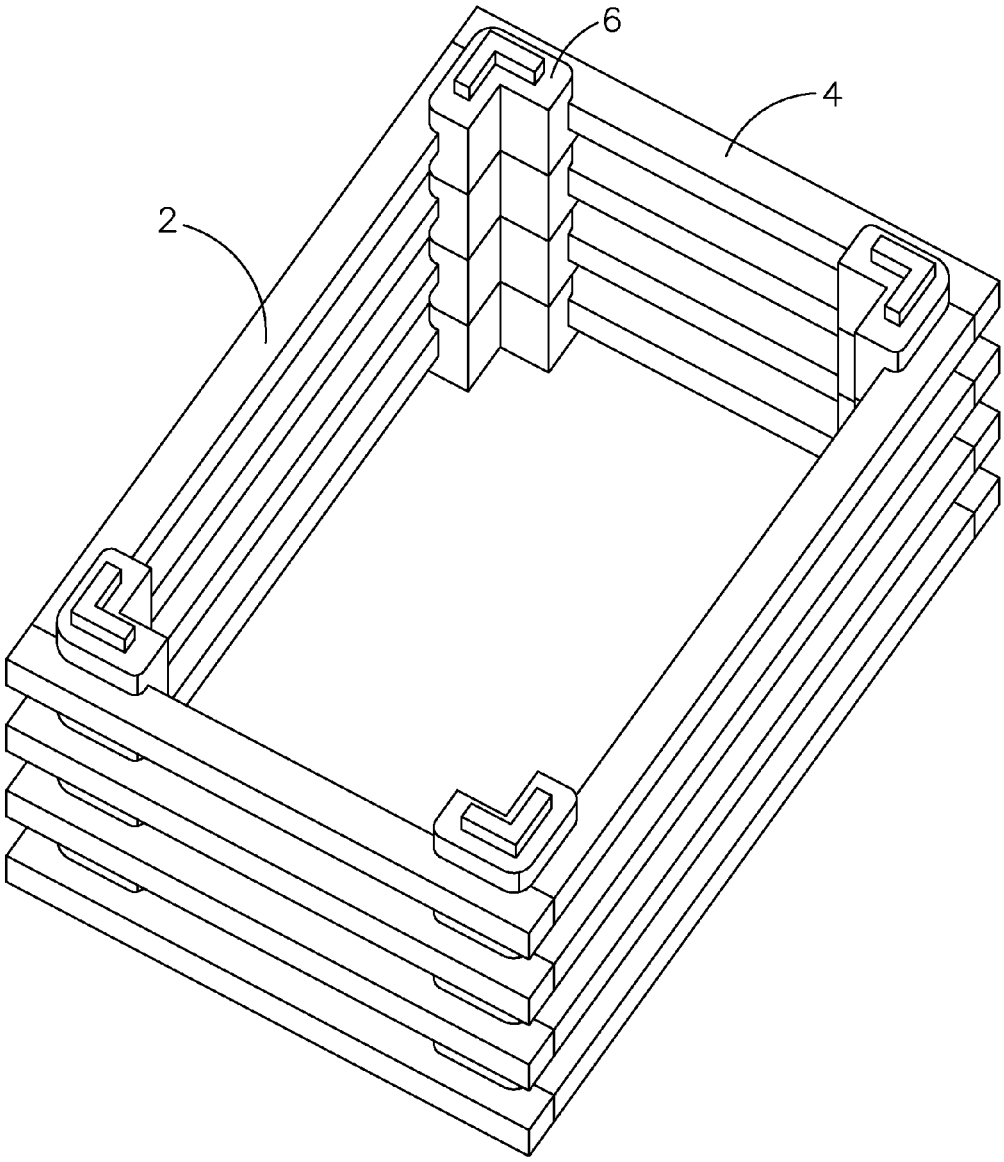
FIG. 6 is a perspective views showing stacking of the dividable packaging structures according to the present invention.

Further, referring to FIGS. 3, 4 and 6, the corner connection pieces 6 each comprises a bottom surface 602 and a top surface 604 opposite to the bottom surface 602. The top surface 604 of one corner connection piece 6 can support the bottom surface 602 of another corner connection pieces 6 so that the two corner connection pieces 6 can be staked together. In the instant embodiment, the top surface 604 of the corner connection pieces 6 is provided with a projection 64 and the bottom surface 602 of the corner connection pieces 6 is provided with a receiving slot 66 that corresponds to the projection 64. The projection 64 of a corner connection piece 6 is receivable in the receiving slot 66 of another corner connection piece 6 to thereby have the two corner connection pieces 6 stacked over each other.

To package a front bezel, the front bezel is first placed on the packaging structure. Specifically, the four edges of the front bezel are respectively positioned on and supported by the first and second side frame members 2, 4 and the corners of the front bezel are respectively fit to the outer sides of the corner connection pieces 6. Afterwards, stacking is carried out (as shown in FIG. 6) and when the stack reaches a predetermined height, an enclosure film is applied to wrap it for dust protection.

In summary, the present invention provides a dividable packaging structure, which has a dividable and thus splittable configuration, allowing for effective reduction of material cost. To package an object, the frame carries and supports the object thereon and the corner connection pieces provide positioning of the object to effectively prevent the object from shifting during shipment that may lead to occurrence of deformation of the object.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A dividable packaging structure, comprising: a plurality of first and second side frame members respectively having predetermined first and second lengths that are each defined between two opposite ends and invariant and a plurality of corner connection pieces respectively connected to the ends of the first and second side frame members, the plurality of corner connection pieces connecting the first side frame members and the second side frame members together to form a frame having a size determined by the first and second lengths of the first and second side frame members that are invariant such that the size of the frame is fixed and a relative position between two of the corner connection pieces is fixed, wherein each of the plurality of corner connection pieces has an inside surface facing each other and an outside surface opposite to the inside surface and facing away from each other and comprises engage-to-couple structures that comprises horizontal slots formed in the outside surface and delimited between opposite banks to respectively and partly receive the first and second side frame members therein for being retained between the opposite banks so as to connect the first and second frame members together to define a unitary horizontal frame having the fixed size adapted to receive and support a bezel having a corresponding size thereon.

2. The dividable packaging structure as claimed in claim 1, wherein the first and second side frame members have the same thickness; the corner connection pieces each have outer sides that comprises engage-to-couple structures corresponding to the first and second side frame members, end sections of the first and second side frame members being engageable with and coupled to the engage-to-couple structures thereby connecting the first and second side frame members together.

3. The dividable packaging structure as claimed in claim 1, wherein the corner connection pieces each comprise a bottom surface and a top surface opposite to the bottom surface, whereby the top surface of the corner connection piece carries and supports thereon the bottom surface of another corner connection piece to thereby stack the two corner connection pieces together.

4. The dividable packaging structure as claimed in claim 3, wherein the top surface of the corner connection pieces comprises a projection and the bottom surface of the corner connection pieces comprises a receiving slot formed therein to correspond to the bottom surface, whereby the projection of a corner connection piece is receivable in the receiving slot of another corner connection piece so as to stack the two corner connection pieces together.

5. The dividable packaging structure as claimed in claim 2, wherein the engage-to-couple structures comprise engage-to-couple slots and the end sections of the first and second side frame members are engageable with and coupled to the engage-to-couple slots to thereby connect the first and second side frame members together in sequence.

6. The dividable packaging structure as claimed in claim 2, wherein the engage-to-couple structures and the end sections of the first and second side frame members are fixed together with adhesives or screwing.

7. The dividable packaging structure as claimed in claim 2, wherein the corner connection pieces are located at an inner side of the frame and the corner connection pieces project upward beyond an external surface of the frame and are adapted to position an object to be packaged, so that the frame bears and supports the object to be packaged thereon.

8. The dividable packaging structure as claimed in claim 1, wherein the number of the corner connection pieces is four; the number of the first side frame members is two that are arranged opposite to each other; and the number of the second side frame members is two that are arranged opposite to each other.

9. The dividable packaging structure as claimed in claim 8, wherein the corner connection pieces are in the form of an L-shape and the frame is rectangular.

10. The dividable packaging structure as claimed in claim 9, wherein the corner connection pieces each comprise round chamfering on an outer side thereof at two ends and a middle bend.

11. A dividable packaging structure, comprising: a plurality of first and second side frame members respectively having predetermined first and second lengths that are each defined between two opposite ends and invariant and a plurality of corner connection pieces respectively connected to the ends of the first and second side frame members, the plurality of corner connection pieces connecting the first side frame members and the second side frame members together to form a frame having a size determined by the first and second lengths of the first and second side frame members that are invariant such that the size of the frame is fixed and a relative position between two of the corner connection pieces is fixed, wherein each of the plurality of corner connection pieces has an inside surface facing each other and an outside surface opposite to the inside surface and facing away from each other and comprises engage-to-couple structures that comprises horizontal slots formed in the outside surface and delimited between opposite banks to respectively and partly receive the first and second side frame members therein for being retained between the opposite banks so as to connect the first and second frame members together to define a unitary horizontal frame having the fixed size adapted to receive and support a bezel having a corresponding size thereon;

wherein the first and second side frame members have the same thickness; the corner connection pieces each have outer sides that comprises engage-to-couple structures corresponding to the first and second side frame members, end sections of the first and second side frame members being engageable with and coupled to the engage-to-couple structures thereby connecting the first and second side frame members together;

wherein the corner connection pieces each comprise a bottom surface and a top surface opposite to the bottom surface, whereby the top surface of the corner connection piece carries and supports thereon the bottom surface of another corner connection piece to thereby stack the two corner connection pieces together;

wherein the top surface of the corner connection pieces comprises a projection and the bottom surface of the corner connection pieces comprises a receiving slot formed therein to correspond to the bottom surface, whereby the projection of a corner connection piece is receivable in the receiving slot of another corner connection piece so as to stack the two corner connection pieces together;

wherein the engage-to-couple structures comprise engage-to-couple slots and the end sections of the first and second side frame members are engageable with and coupled to the engage-to-couple slots to thereby connect the first and second side frame members together in sequence; and wherein the engage-to-couple structures and the end sections of the first and second side frame members are fixed together with adhesives or screwing.

12. The dividable packaging structure as claimed in claim 11, wherein the corner connection pieces are located at an inner side of the frame and the corner connection pieces project upward beyond an external surface of the frame and are adapted to position an object to be packaged, so that the frame bears and supports the object to be packaged thereon.

13. The dividable packaging structure as claimed in claim 11, wherein the number of the corner connection pieces is four; the number of the first side frame members is two that are arranged opposite to each other; and the number of the second side frame members is two that are arranged opposite to each other.

14. The dividable packaging structure as claimed in claim 13, wherein the corner connection pieces are in the form of an L-shape and the frame is rectangular.

15. The dividable packaging structure as claimed in claim 14, wherein the corner connection pieces each comprise round chamfering on an outer side thereof at two ends and a middle bend.

* * * * *